US006937840B2

(12) United States Patent
Chung

(10) Patent No.: US 6,937,840 B2
(45) Date of Patent: Aug. 30, 2005

(54) PAPER GUIDE AND ELECTROPHOTOGRAPHIC FORMING APPARATUS HAVING THE SAME

(75) Inventor: Kyung Shig Chung, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/724,059

(22) Filed: Dec. 1, 2003

(65) Prior Publication Data

US 2004/0175214 A1 Sep. 9, 2004

(30) Foreign Application Priority Data

Mar. 4, 2003 (KR) ..... 10-2003-0013445

(51) Int. Cl.[7] ..... G03G 15/00

(52) U.S. Cl. ..... 399/400; 399/316; 399/328; 400/642

(58) Field of Search ..... 399/400, 328, 399/316, 297, 320; 400/642; 271/642

(56) References Cited

U.S. PATENT DOCUMENTS 4,768,063 A * 8/1988 Kunishima et al. ..... 355/29
5,212,532 A * 5/1993 Storlie ..... 399/167
5,337,128 A * 8/1994 Hashizume et al. ..... 399/314
5,802,432 A * 9/1998 Coffey et al. ..... 399/110
5,921,542 A * 7/1999 Ohno et al. ..... 271/121
6,040,919 A * 3/2000 Iwata et al. ..... 358/400
6,327,455 B1 * 12/2001 Hamilton et al. ..... 399/331
6,382,858 B1 * 5/2002 Nojima et al. ..... 400/691
6,393,246 B2 * 5/2002 Tsujihara ..... 399/322
6,741,832 B2 * 5/2004 Tomatsu ..... 399/400
6,810,229 B2 * 10/2004 Coleman et al. ..... 399/323

FOREIGN PATENT DOCUMENTS

JP 2002-337403 11/2002

* cited by examiner

*Primary Examiner*—Andrew H. Hirshfeld
*Assistant Examiner*—Dave A. Ghatt
(74) *Attorney, Agent, or Firm*—Staas & Halsey LLP

(57) ABSTRACT

A paper guide which does not make stripes on an image on a printing paper. The paper guide of an electrophotographic image forming apparatus includes a guiding member for guiding the printing paper into a fusing unit, a plurality of guiding ribs formed on the guiding member to prevent direct contact of the printing paper with the guiding member, and a blocking bar formed on a leading end near the fusing unit of the guiding member in order that the spaces between the plurality of guiding ribs are blocked from the fusing unit. The blocking bar is formed at the same height as the guiding ribs and has a triangular section with a slope steeper than the section of the guiding ribs.

21 Claims, 6 Drawing Sheets

PAPER GUIDE AND ELECTROPHOTOGRAPHIC FORMING APPARATUS HAVING THE SAME

CROSS-REFERENCE TO RELATED APPLICATIONS

This application claims the benefit of Korean Application No. 2003-13445, filed on Mar. 4, 2003, in the Korean Intellectual Property Office, the disclosure of which is incorporated herein by reference.

BACKGROUND OF THE INVENTION

1. Field of the Invention

The present invention is related to an image forming apparatus such as a copier or a printer, and more particularly, to a paper guide for guiding a printing paper entering a fusing unit of an electrophotographic image forming apparatus.

2. Description of the Related Art

In general, the method of printing an image on a printing paper in an electrophotographic image forming apparatus comprises transcribing a predetermined image, which is developed by a toner on a printing paper, fusing the transcribed image onto the printing paper by heating and pressing, and then discharging the printing paper through a paper discharging unit. The image forming apparatus comprises a paper guide between a developing unit and a fusing unit, for guiding the printing paper from the developing unit to the fusing unit. The paper guide 10 comprises a plurality of guiding ribs 13 on a guiding member 11, as shown in FIG. 1 to avoid staining an unprinted face of a printing paper in one side printing or a preprinted face in double side printing by the paper guide 10.

Further, in order to prevent the printing paper passed through the fusing unit from creasing, the center of the paper guide may be formed higher than both of the edge side (Japanese Patent No. 2002-337403).

However, the paper guide 10 causes a plurality of stripes 22 on an image which is fused on the printing paper 20 after the paper 20 has passed through the fusing unit along the paper guide 10, as shown in FIG. 2. The stripes 22 occur at positions corresponding to positions of a plurality of guiding ribs 13 formed in the paper guide 10 due to a temperature difference between the guiding ribs 13 and spaces 15 between the guiding ribs 13. That is, different degrees of heat are transferred onto the printing paper 20 from the paper guide 10 depending on whether the printing paper 20 contacts the guiding ribs 13 or the spaces 15. Accordingly, a density difference occurs on the image fused by the fusing unit, causing a plurality of stripes 22 on the printed image 21.

Accordingly, in order to overcome the above and/or other problems, a paper guide of an electrophotographic image forming apparatus, which does not stain a printing paper with stripes after fusing is needed.

SUMMARY OF THE INVENTION

Accordingly, it is an aspect of the present invention to provide a paper guide of an image forming apparatus which does not leave stripes on an image after the printing paper has passed through guiding ribs by uniformly transferring heat onto the printing paper.

It is another aspect of the present invention to provide an electrophotographic image forming apparatus having the above paper guide which does not leave stripes on an image after fusing is completed.

Additional aspects and/or advantages of the invention will be set forth in part in the description which follows and, in part, will be obvious from the description, or may be learned by practice of the invention.

The foregoing and/or other aspects of the present invention are achieved by providing a paper guide of an electrophotographic image forming apparatus for guiding a printing paper into a fusing unit, the paper guide comprising a guiding member for guiding a printing paper into a fusing unit, a plurality of guiding ribs formed on the guiding member to prevent direct contact of the printing paper with the guiding member, and a blocking bar formed on leading end near the fusing unit of the guiding member wherein a plurality of spaces between the plurality of guiding ribs are blocked by the blocking bar from a space where the fusing unit is formed.

The blocking bar has a triangular section with a slope steeper than a section of the guiding ribs. The paper guide] may be made by a mold or a press.

Additionally, the blocking bar is formed at the same height as the guiding ribs, and has a triangular section with a slope steeper than the section of the guiding ribs.

It is another aspect of the present invention to provide an electrophotographic image forming apparatus, comprising a paper supplying unit storing and supplying printing papers, a developing unit developing an image on the printing paper supplied by the paper supplying unit, a fusing unit fusing an image developed on the printing paper, and a paper guide guiding the printing paper to the fusing unit after the printing paper has passed through the developing unit, the paper guide comprises guiding ribs formed on the guiding member in a paper advancing direction to prevent direct contact of the printing paper with the guiding member, and a blocking bar formed on a leading end near the fusing unit of the guiding member in order that the spaces between the plurality of guiding ribs are blocked by the blocking bar from a space where the fusing unit is formed.

The blocking bar is formed at the same height as the guiding ribs, and is a triangular section with a slope steeper than the section of the guiding ribs.

BRIEF DESCRIPTION OF THE DRAWINGS

These together with other aspects and advantages of the invention will become apparent and more readily appreciated from the following description of the embodiments, taken in conjunction with the accompanying drawings of which.

These together with other, aspects and advantages of the invention will become more apparent and more readily appreciated from the following description of the preferred embodiments taken in conjunction with the accompanying drawings of which.

DETAILED DESCRIPTION OF THE PREFERRED EMBODIMENTS

Figure 1:
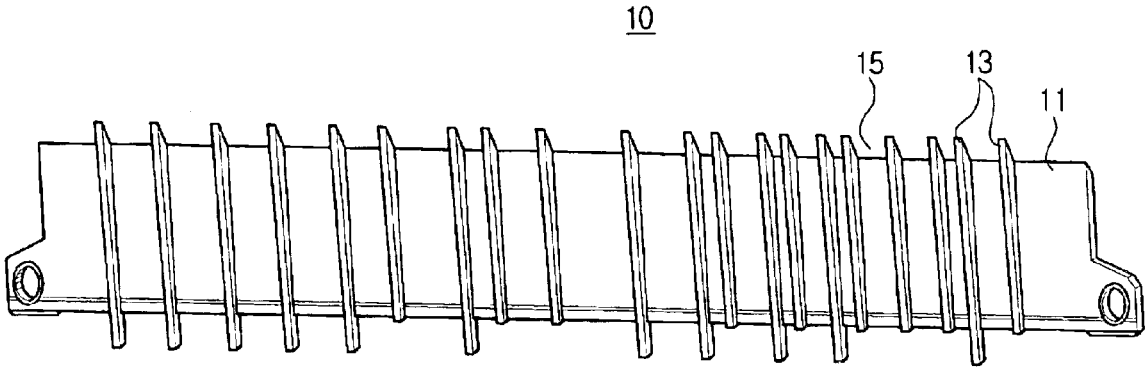
FIG. 1 (PRIOR ART)
FIG. 1 is a perspective view showing a conventional paper guide of an electrophotographic image forming apparatus.
Figure 2:
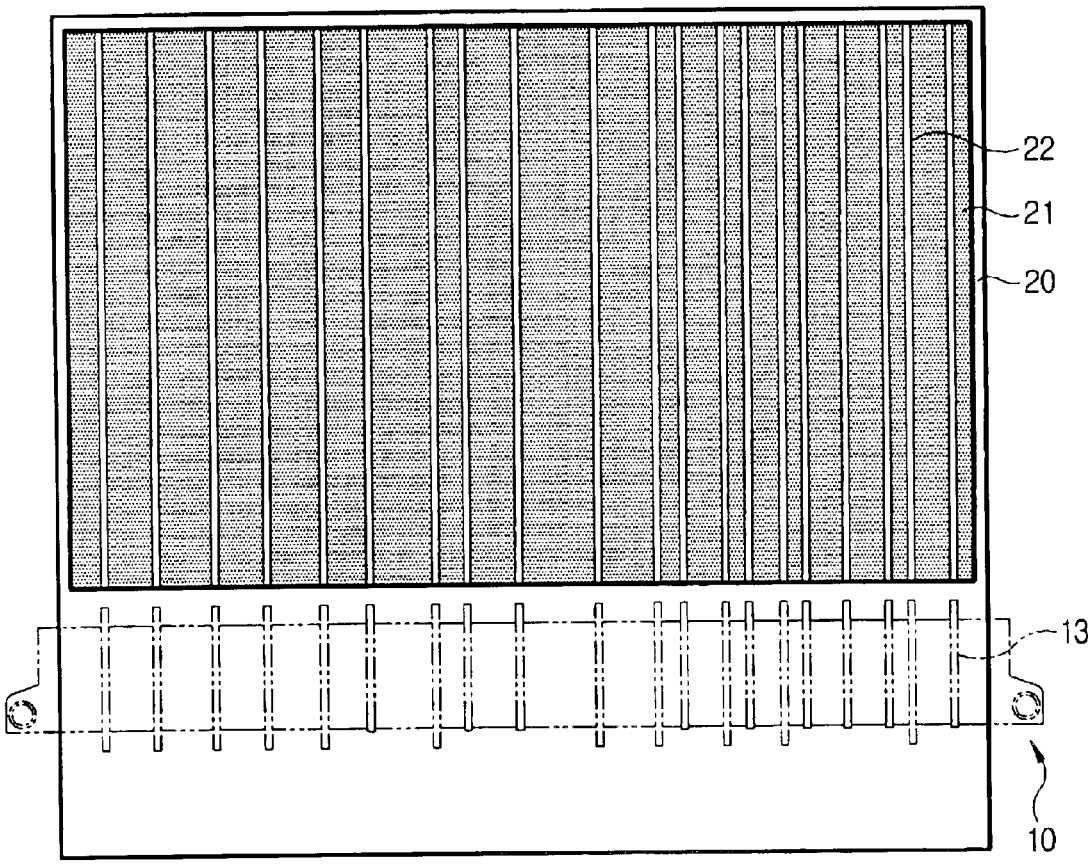
FIG. 2 (PRIOR ART)
FIG. 2 is a drawing illustrating a printing paper on which an image is fused after the printing paper has been guided through a fusing unit by the paper guide.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 3:
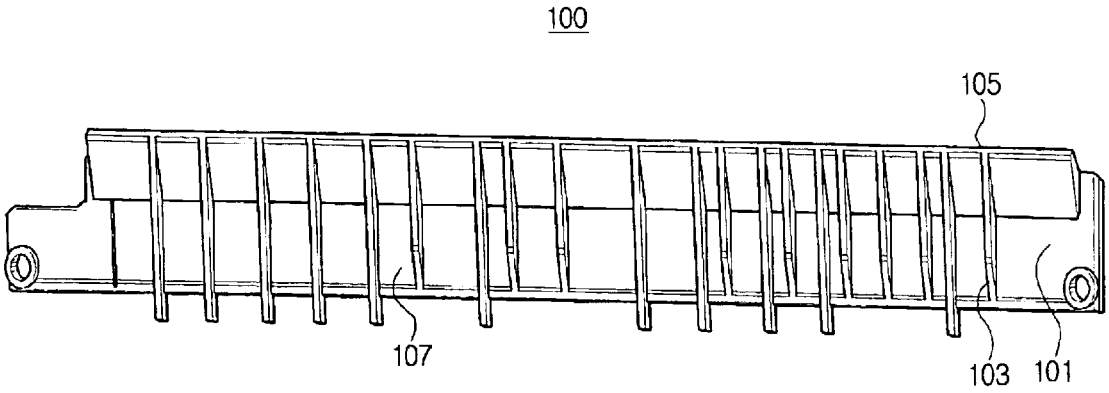
FIG. 3 is a perspective diagram showing a paper guide of an electrophotographic image forming apparatus according to an embodiment of the present invention.
Figure 4:
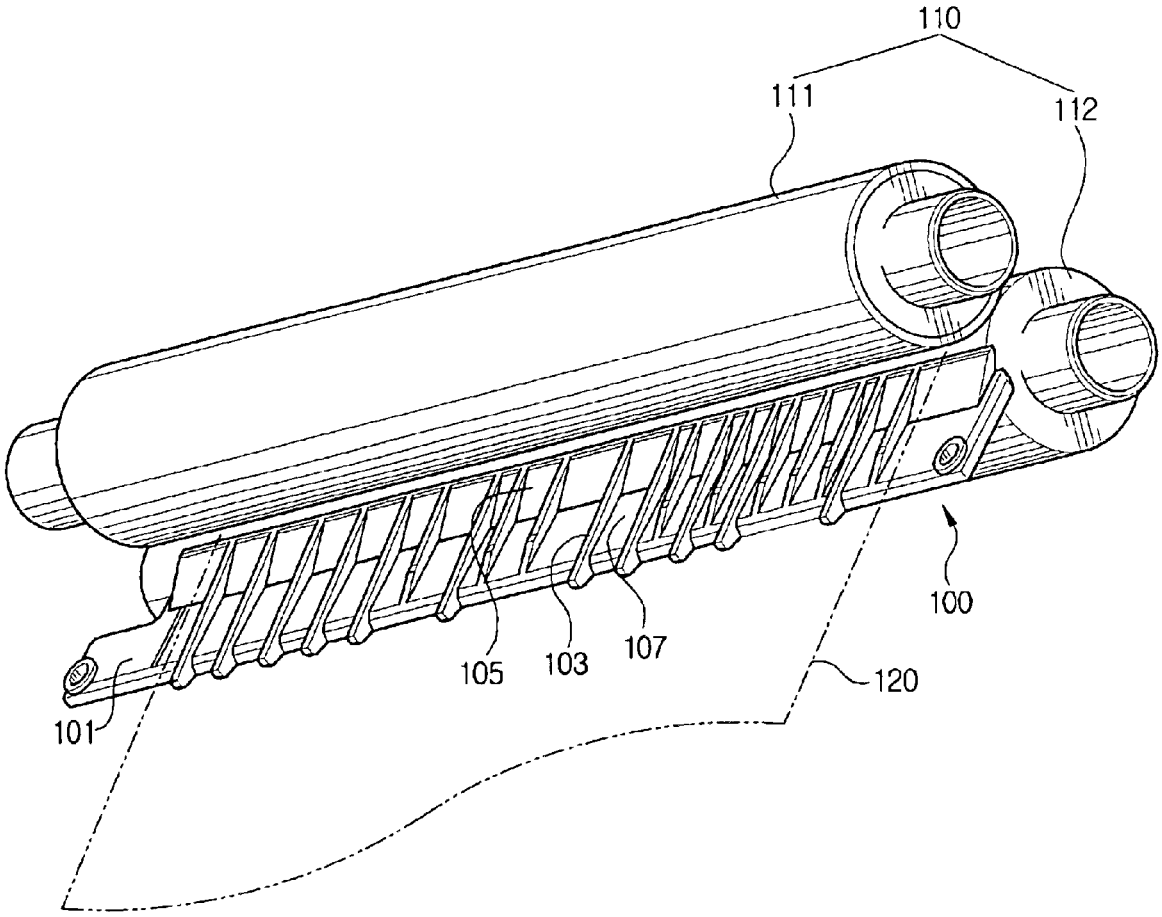
FIG. 4 is a drawing illustrating the paper guide of FIG. 3, located on the front of a fusing unit.
Figure 5:
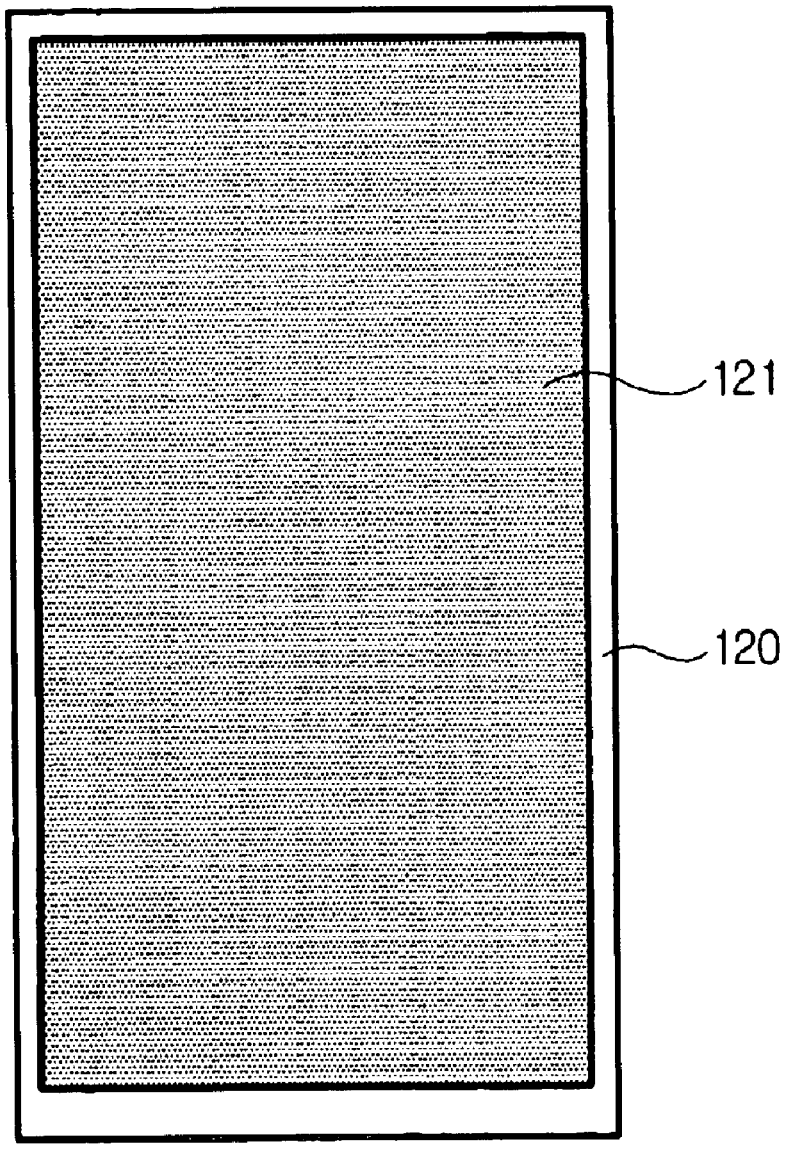
FIG. 5 is a drawing illustrating an image fused on a printing paper which is guided through the fusing unit by the paper guide of FIG. 3.

Referring to FIG. 3 and FIG. 4, a paper guide 100 according to the present invention comprises a guiding member 101, a plurality of guiding ribs 103 and a blocking bar 105.

The guiding member 101 guides a printing paper 120, onto which an image developed by a toner at a developing unit (not shown) is transcribed, smoothly into a fusing unit 110. The guiding member 101 is located on the front of a fusing unit 110 and is formed in a shape of a plate for supporting the printing paper 120.

The guiding ribs 103 are for preventing contamination on a side of the printing paper 120, by preventing direct contact of the printing paper 120 with the guiding member 101 while the printing paper 120 is fed along the guiding member 101. The guiding ribs 103 are disposed at a right angle to a length direction of the guiding member 101. The number of guiding ribs 103 and the intervals between them are determined properly so that the printing paper 120 may enter a fusing unit 110 at a horizontal plane.

The blocking bar 105 is for blocking spaces 107 between the guiding ribs 103 from a space where the fusing unit 110 is formed, and the blocking bar 105 is located on the front of the guiding member 101 in a paper advancing direction. Therefore, the guiding ribs 103 are connected to the blocking bar 105, as shown in FIG. 3. A section of the blocking bar 105 is formed in a triangular section with a slope steeper and longer than the guiding ribs 103 in order to enhance the heat transfer of air filled in the spaces 107 and to simplify the manufacturing process.

When the blocking bar 105 is disposed on a leading end of the guiding member 101, in the proximity of the fusing unit 110, air in a plurality of spaces 107 which are formed by the guiding ribs 103 is blocked from an outside air so as to remain at the same temperature as the guiding ribs 103.

In addition, the paper guide 100 described above can be made by a molding, such as a plastic mold or a metal press.

An operation of the paper guide having the above structure of the present invention will now be described in detail.

Figure 6:
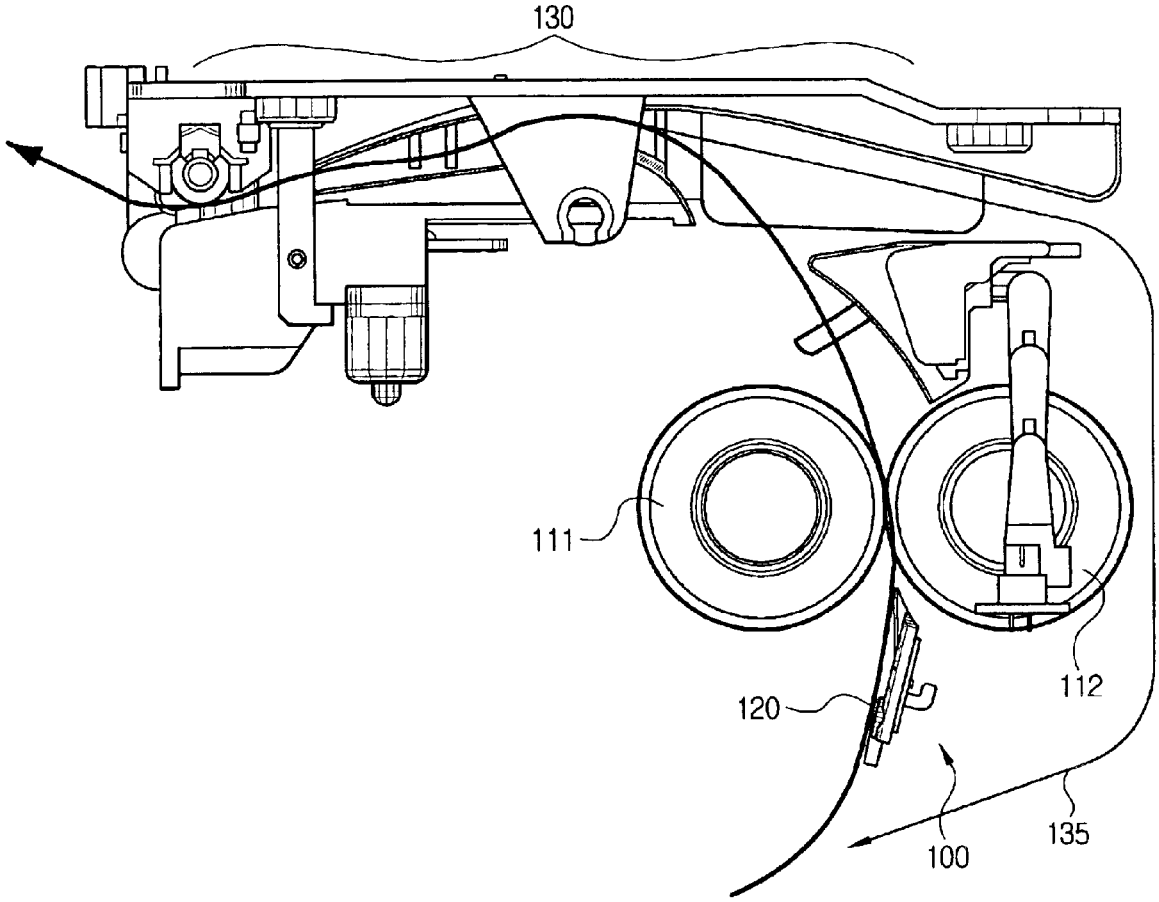
FIG. 6 is a sectional view of the fusing unit and a paper supplying unit of the electrophotographic image forming apparatus having the paper guide according to the present invention.

FIG. 6 illustrates a schematic sectional diagram of the fusing unit 110 and the paper discharging unit 130 of the electrophotographic image forming apparatus having the paper guide 100.

Referring to FIG. 4 and FIG. 6, the printing paper 120 having a predetermined developed image at the developing unit (not shown), travels over the paper guide 100.

The printing paper 120 which travels over the paper guide 100 is conveyed to the fusing unit 110 as a side of the printing paper is sliding on the guiding ribs 103. More specifically, when the printing paper 120 is positioned on the guiding ribs 103 of the paper guide 100, the spaces 107 become enclosed and only open to the developing unit. Therefore, the spaces 107 are roughly formed in a hexahedron shape having the guiding ribs 103 as both sidewalls, the printing paper 120 as a ceiling, and the blocking bar 105 as a front wall. The hexahedron is only open to the rear side. Then, air within the spaces 107 is stagnant inside, and accordingly, the spaces are heated by the heat transmitted through the paper guide 100 and maintain the same temperature with the paper guide 100. That is, the same level of heat is transmitted both to portions of the printing paper 120 in contact with the guiding ribs 103 and portions of the printing paper 120 in contact with the spaces 107.

The printing paper 120 travels over the paper guide 100, and then enters between a heating roller 111 and a pressing roller 112 of the fusing unit 110. Accordingly, a toner is completely fused onto the printing paper 120 by heat and pressure. After the image is fused onto the printing paper at the fusing unit 110, the printing paper 120 is discharged by a paper discharging unit 130. In case of double-side printing, the printing paper 120 which is completely fed out of the fusing unit 110 is now fed backward from the paper discharging unit 130 into a double-side printing path 135, and therefore, the printing paper 120 enters the developing unit (not shown) with the unprinted side facing upward. Next, the printing paper 120 is sequentially conveyed through the paper guide 100, the fusing unit 110 and the paper discharging unit 130, and thus, a printing process is completed.

In a paper guide of an electrophotographic image forming apparatus according to the present invention described above, heat is equally transmitted to the printing paper 120 which is fed along the paper guide 100. Therefore, undesired stripes do not occur on the printed image 121 on the printing paper 120 which passed through the fusing unit 110.

Further, an electrophotographic image forming apparatus having a paper guide 100 according to the present invention does not make stripes on the image 121 of the printing paper 120 after printing.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A paper guide of an electrophotographic image forming apparatus for guiding a printing paper entering a fusing unit, the paper guide comprising:

a guiding member guiding the printing paper into the fusing unit;

a plurality of guiding ribs formed on the guiding member to prevent direct contact of the printing paper with the guiding member; and a blocking bar formed on a leading end near the fusing unit of the guiding member, the blocking bar is slanted upward in a direction towards the fusing unit such that a tog portion of the plurality of guiding ribs contacts with a too portion of the blocking bar, wherein a plurality of spaces between the plurality of guiding ribs are blocked by the blocking bar from a space where the fusing unit is formed.

2. A paper guide of an electrophotographic image forming apparatus for guiding a printing paper entering a fusing unit, the paper guide comprising:

a guiding member guiding the printing paper into the fusing unit;

a plurality of guiding ribs formed on the guiding member to prevent direct contact of the printing paper with the guiding member; and a blocking bar formed on a leading end near the fusing unit of the guiding member wherein a plurality of spaces between the plurality of guiding ribs are blocked by the blocking bar from a space where the fusing unit is formed, wherein the blocking bar has a triangular section with a slope steeper than a section of the guiding ribs.

3. The paper guide of claim 2, wherein the paper guide is made by a mold.

4. The paper guide of claim 2, wherein the paper guide is made by a press.

5. The paper guide of claim 2, wherein the blocking bar is formed at a same height as the guiding ribs.

6. The paper guide of claim 5, wherein the blocking bar has a triangular section with a slope steeper than a section of the guiding ribs.

7. The paper guide of claim 6, wherein the paper guide is made by a mold.

8. The paper guide of claim 6, wherein the paper guide is made by a press.

9. The paper guide of claim 2, wherein the plurality of spaces are heated by heat transmitted through the paper guide and maintain a same temperature as the paper guide.

10. The paper guide of claim 2, wherein heat is uniformly transmitted to a portion of the printing paper in contact with the plurality of guiding ribs and the portion of the printing paper in contact with the plurality of spaces.

11. The paper guide of claim 2, wherein the blocking bar is located on a front of the guiding member in a paper advancing direction.

12. The paper guide of claim 2, wherein the plurality of guiding ribs are formed on the guiding member in a paper advancing direction.

13. An electrophotographic image forming apparatus comprising:

a paper supplying unit storing and supplying printing papers;

a developing unit developing an image on the printing paper supplied by the paper supplying unit;

a fusing unit fusing the image developed on the printing paper; and a paper guide guiding the printing paper to the fusing unit after the printing paper has passed through the developing unit, wherein the paper guide comprises guiding ribs formed on a guiding member to prevent direct contact of the printing paper with the guiding member, and a blocking bar formed on a leading end near the fusing unit of the guiding member, wherein a plurality of spaces between the plurality of guiding ribs are blocked by the blocking bar from a space where the fusing unit is formed.

14. The electrophotographic image forming apparatus of claim 13, wherein the blocking bar is formed at a same height as the guiding ribs.

15. The electrophotographic image forming apparatus of claim 14, wherein the blocking bar has a triangular section with a slope steeper than a section of the guiding ribs.

16. The electrophotographic image forming apparatus of claim 15, wherein the paper guide is made by a mold.

17. The electrophotographic image forming apparatus of claim 15, wherein the paper guide is made by a press.

18. The electrophotographic image forming apparatus of claim 13, wherein the plurality of spaces are heated by heat transmitted through the paper guide and maintain a same temperature as the paper guide.

19. The electrophotographic image forming apparatus of claim 13, wherein heat is uniformly transmitted to a portion of the printing paper in contact with the plurality of guiding ribs and the portion of the printing paper in contact with the plurality of spaces.

20. An electrophotographic image forming apparatus comprising:

a paper supplying unit which stores and supplies printing papers;

a developing unit which develops an image on the printing paper supplied by the paper supplying unit;

a fusing unit which fuses the image developed on the printing paper; and a paper guide which guides the printing paper to the fusing unit after the printing paper has passed through the developing unit, the paper guide comprising a plurality of guiding ribs formed on a guiding member, and a blocking bar formed on a leading end near the fusing unit of the guiding member, wherein a plurality of spaces are formed in a hexahedron shape and enclosed by the printing paper on a top portion and the blocking bar on a front portion and open on a rear portion to the developing unit when the printing paper is positioned on the plurality of guiding ribs.

21. A paper guide of an electrophotographic image forming apparatus for guiding a printing paper entering a fusing unit, the paper guide comprising:

a guiding member guiding the printing paper into the fusing unit;

a plurality of guiding ribs formed on the guiding member to prevent direct contact of the printing paper with the guiding member; and a blocking bar disposed on a leading end of the guiding member in a proximity of the fusing unit, the blocking bar slanted upward in a direction towards the fusing unit such that a top portion of the plurality of guiding ribs contacts with a top portion of the blocking bar, wherein air in a plurality of spaces formed by the plurality of guiding ribs, is blocked from an outside air so as to remain at a same temperature as the plurality of guiding ribs.

* * * * *

UNITED STATES PATENT AND TRADEMARK OFFICE

CERTIFICATE OF CORRECTION

PATENT NO. : 6,937,840 B2
APPLICATION NO. : 10/724059
DATED : August 30, 2005
INVENTOR(S) : Kyung Shig Chung It is certified that error appears in the above-identified patent and that said Letters Patent is hereby corrected as shown below:

Column 4, line 55, Claim 1, replace “tog” with --top--, therefor;

Column 4, line 56, Claim 1, replace “too” with --top--, therefor.

Signed and Sealed this

Fourth Day of July, 2006

JON W. DUDAS
*Director of the United States Patent and Trademark Office*